US010733885B2

(12) United States Patent
Cho et al.

(10) Patent No.: US 10,733,885 B2
(45) Date of Patent: Aug. 4, 2020

(54) MULTI-VEHICLE PREDICTION SYSTEM

(71) Applicant: Complete Innovations Inc., Toronto (CA)

(72) Inventors: Jihyun Cho, Toronto (CA); Muhamad Samji, Brampton (CA); Alan Fong, Richmond Hill (CA); Tony Lourakis, Toronto (CA); Victor Lan, Thornhill (CA); Pantelis Chatzinikolis, Toronto (CA); Wei Zhou, Markham (CA)

(73) Assignee: Complete Innovations Inc., Toronto (CA)

( * ) Notice: Subject to any disclaimer, the term of this patent is extended or adjusted under 35 U.S.C. 154(b) by 126 days.

(21) Appl. No.: 16/002,256

(22) Filed: Jun. 7, 2018

(65) Prior Publication Data

US 2019/0378410 A1 Dec. 12, 2019

(51) Int. Cl.
*G08G 1/09* (2006.01)
*G08G 1/01* (2006.01)

(52) U.S. Cl.
CPC ..... *G08G 1/093* (2013.01); *G08G 1/0125* (2013.01); *G08G 1/0141* (2013.01); *G08G 1/094* (2013.01)

(58) Field of Classification Search
CPC ..... G08G 1/093; G08G 1/094; G08G 1/0141; G08G 1/0125
USPC ..... 701/117
See application file for complete search history.

(56) References Cited

U.S. PATENT DOCUMENTS 8,279,083 B2 10/2012 Tengler et al.
9,313,047 B2 * 4/2016 Michels ..... H04L 12/6418
2009/0006559 A1 1/2009 Bhogal et al.
2009/0016599 A1 * 1/2009 Eaton ..... G06K 9/00335 382/159
2015/0332523 A1 * 11/2015 Ranasinghe ..... H04W 24/10 701/34.2

(Continued)

OTHER PUBLICATIONS

Sha-Mohammad, "Wireless Networking for Vehicle to Infrastructure Communication and Automatic Incident Detection", Old Dominion University, ODU Digital Commons—Computer Science Theses & Dissertations, Computer Science—pp. 1-117—Retrieved from the internet on Aug. 6, 2019 at URL: https://digitalcommons.odu.edu/computerscience etds/63/.

(Continued)

*Primary Examiner* — Jonathan M Dager
*Assistant Examiner* — Jean W Charleston
(74) *Attorney, Agent, or Firm* — Stratford Managers Corporation

(57) ABSTRACT

A method of operating an incident avoidance system for use in a vehicle comprises a gateway receiving a plurality of vehicular data samples from a plurality of data sources in a vicinity of a target vehicle. A stream processor coupled to the gateway, categorizes a first plurality of low latency data samples from the plurality of vehicular data samples based on an allowable latency of each of the plurality of vehicular data samples. A rules engine coupled to the stream processor, receives the plurality of low latency data samples. The rules engine produces a predictive model based on the plurality of low latency data samples. A notification service accesses the predictive model and situational data of the target vehicle to predict an incident. The notification service transmits a notification of the incident to the target vehicle.

14 Claims, 4 Drawing Sheets

(56) References Cited

U.S. PATENT DOCUMENTS

| | | | | |
|---|---|---|---|---|
| 2016/0028824 | A1* | 1/2016 | Stenneth | B60Q 9/008 709/219 |
| 2016/0197669 | A1* | 7/2016 | Babich | H04B 7/18504 370/315 |
| 2017/0248950 | A1* | 8/2017 | Moran | G08G 1/165 |
| 2018/0090005 | A1* | 3/2018 | Philosof | G08G 1/163 |
| 2018/0299284 | A1* | 10/2018 | Wang | G08G 1/0141 |
| 2019/0364492 | A1* | 11/2019 | Azizi | H04W 68/005 |

OTHER PUBLICATIONS

International Search Report from corresponding PCT application No. PCT/CA2019/050795, Aug. 6, 2019.

* cited by examiner

MULTI-VEHICLE PREDICTION SYSTEM

BACKGROUND OF THE INVENTION

Field of the Invention

The present invention relates to the field of vehicle telematics and more particularly to the collection and use of vehicle telematics data to predict obstacles that may not be observable by other means.

Description of Related Art

Safety features of vehicles have been improving over time reducing injuries and deaths for both drivers and passengers. A number of trends have helped to implement these systems. One such trend is the computerization of vehicles and vehicle components. Another trend is the ubiquity of wireless communication systems and networks.

A modern vehicle has hundreds of computer controller components and modules that control and monitor all aspects of the vehicles operation. This includes speed, braking, deceleration, location, number of passengers, tire pressure, engine and fluid temperatures, environmental conditions, and many more. Components are connected through communications buses such as Controller Area Network (CAN), Local Interconnect Network (LIN), and others. Electronic logging devices (ELDs), also known as electronic log books for truck drivers have been mandated in the United States.

Assisted driving and self-driving vehicles are now a reality using sensors such as cameras, radar, and lidar to detect obstacles, detect the lane surface. In assisted driving systems, these sensors allow for a driver to be pre-emptively alerted to obstacles before they are visible and allow them time to reduce speed or avoid the obstacle. Self-driving vehicles may do all this automatically with or without driver supervision.

Many vehicles also include cellular modems that allow external communications to upload or download data, or to call for aid if required. One such system is from OnStar Corporation which provides services such as Automatic Crash Response, Stolen Vehicle Tracking, Turn-by-Turn Navigation, and Roadside Assistance to their subscribers.

As these monitoring, sensing, and communications systems become more widespread the amount of data available becomes staggering. This applies to the collection of data, the transmission or data, the analysis of the data, and taking an action based on the analyzed data. Different data, such as data that allows for collision avoidance, is time sensitive. Other data that reveals slow changing or repetitive events over time are not time sensitive. The differences in data and the vast amount of data makes the task of extracting value from the large amount of data difficult to do in a timely and accurate manner.

There exists a need for new techniques and methods to make use of this large amount of valuable data.

Other aspects and features of the present invention will become apparent to those ordinarily skilled in the art upon review of the following description of specific embodiments of the invention in conjunction with the accompanying figures.

BRIEF SUMMARY OF THE INVENTION

In accordance with an embodiment of the invention there is provided a method and system of operating an incident avoidance system for use in a vehicle, the method comprising a gateway receiving a plurality of vehicular data samples from a plurality of data sources in a vicinity of a target vehicle. A stream processor coupled to the gateway categorizes a plurality of low latency data samples from the plurality of vehicular data samples based on an allowable latency of each of the plurality of vehicular data samples. A rules engine coupled to the stream processor receives the plurality of low latency data samples. The rules engine derives a predictive model based on the plurality of low latency data samples. A notification service accesses the predictive model and situational data of the target vehicle to predict an incident and the notification service transmits a notification of the incident to the target vehicle.

Further aspects comprise the stream processor categorizing a plurality of high latency data samples from the plurality of vehicular data samples based on a predefined latency of each of the plurality of vehicular data samples. The stream processor stores the plurality of high latency data samples in a data lake and a batch processor processes the plurality of high latency data samples.

In other aspects the gateway converts each of the plurality of vehicular data samples into a common internal format.

Further aspects comprise storing a copy of each of the plurality of vehicular data samples in the common internal format.

According to other aspects a subsequent low latency data sample received by the rules engine is used to update the predictive model. In other aspects the predictive model is also derived based on the plurality of high latency data samples. In further aspects the predictive model comprises an offline model and an online model.

Other aspects and features of the present invention will become apparent to those ordinarily skilled in the art upon review of the following description of specific embodiments of the invention in conjunction with the accompanying figures.

BRIEF DESCRIPTION OF THE SEVERAL VIEWS OF THE DRAWING(S)

Embodiments of the present invention will now be described, by way of example only, with reference to the attached Figures, wherein.

DETAILED DESCRIPTION OF THE INVENTION

The present invention relates to the field of vehicle telematics and more particularly to the collection and use of vehicle telematics data to predict obstacles that may not be observable by other means.

Embodiments of the invention comprise a central server that comprises computing and networking hardware and software to gather, store, analyze, and utilize information about a vehicle's status, surrounding conditions, driver behaviour, and other information. It is understood that the server may be a single server or several servers and may be located in a single location or multiple locations as is known in the art. Vehicle status includes its health status gathered from networked components and includes information gathered from the engine, brakes, lights, and other components and modules. Embodiments aim to provide a sufficient and optimal dataset for development of autonomous driving, driving infrastructure, and smart cities. Embodiments provide not only data from optical based technologies like optical cameras, radar, LiDAR but also data that are not yet within line of sight, for example around a blind corner, over a hill into a blind horizon, etc.

Figure 1:
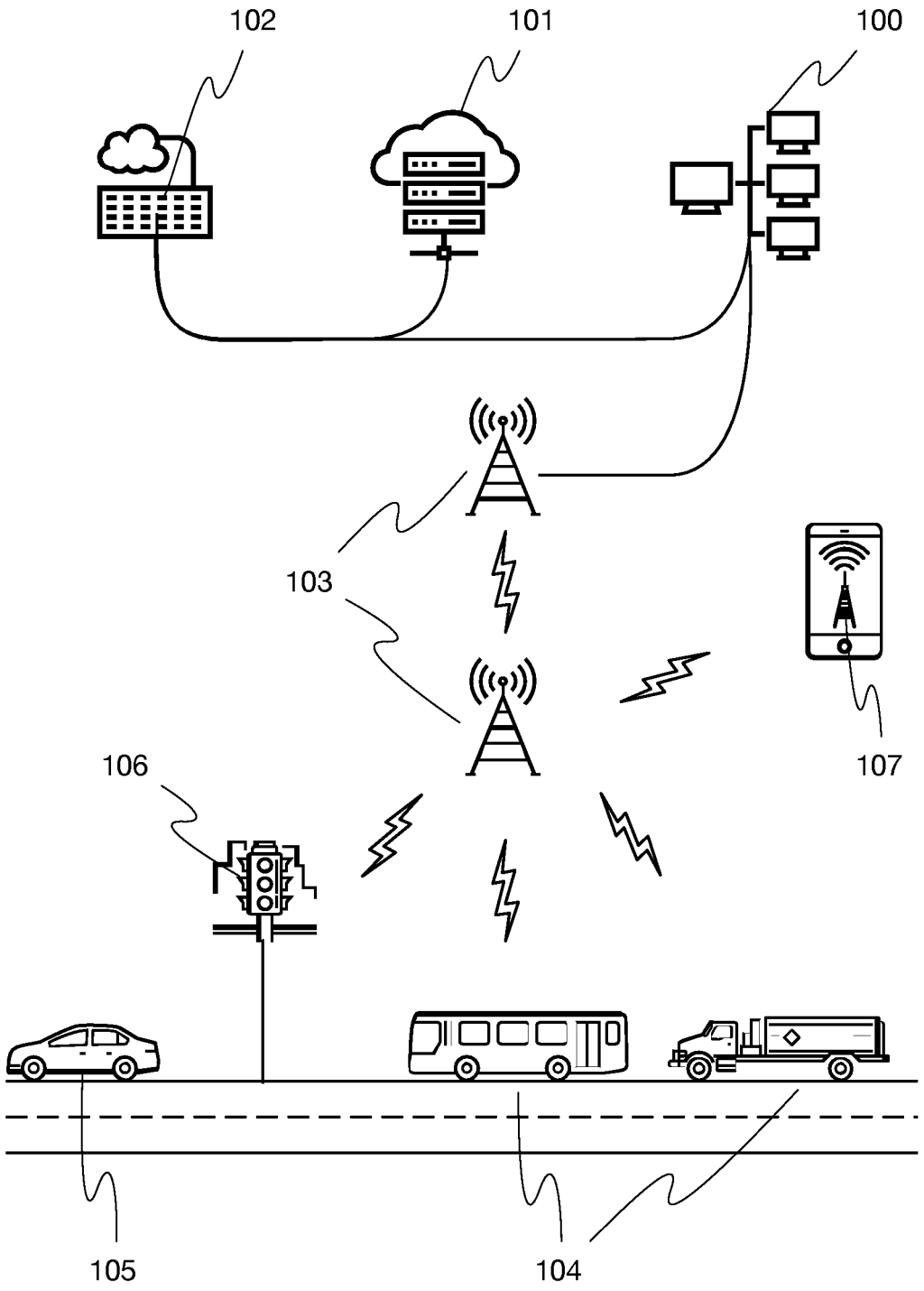
FIG. 1 depicts a network environment supporting embodiments of the invention.
Figure 2:
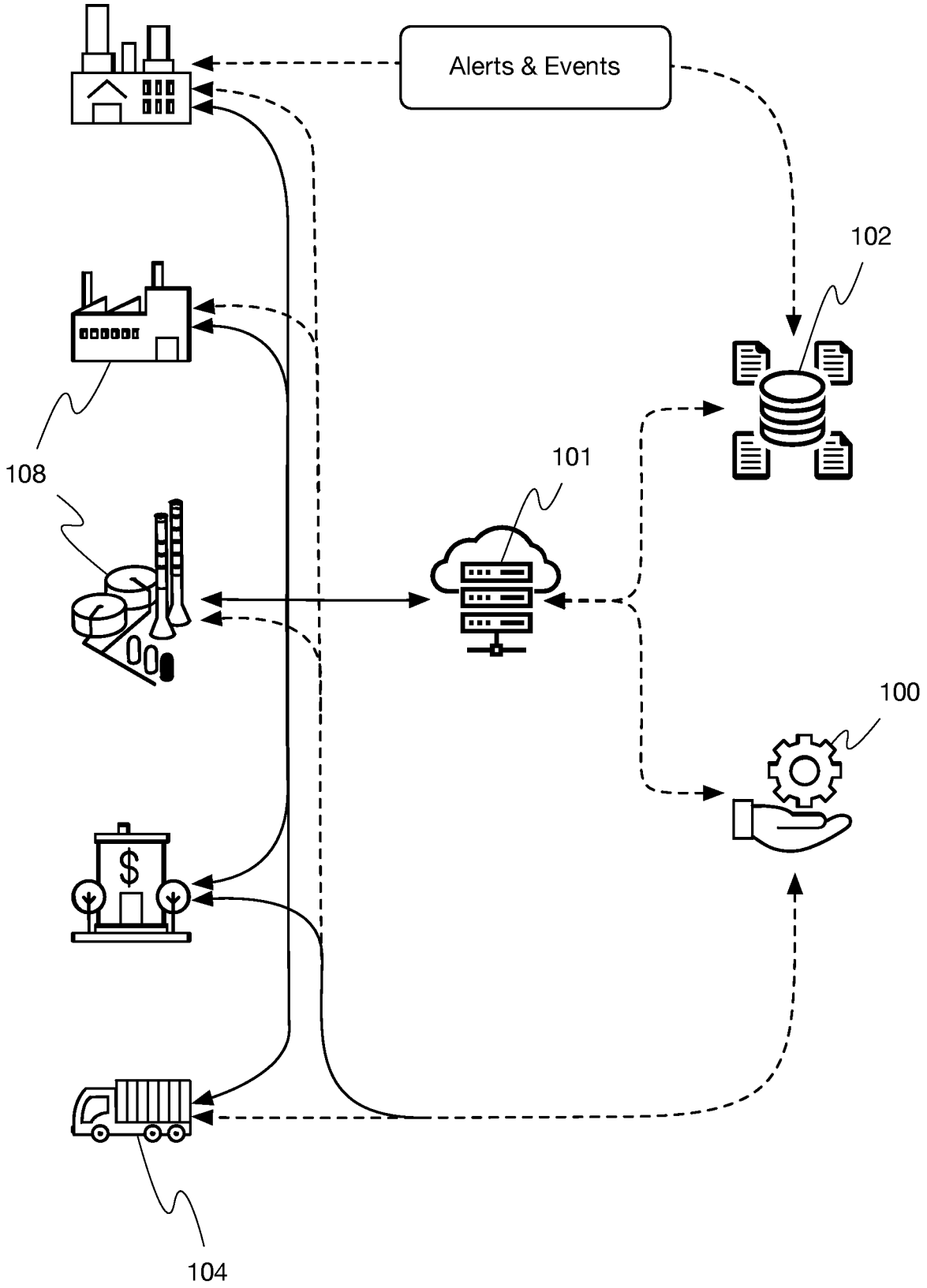
FIG. 2 depicts an electronic device supporting embodiments of the invention.
Figure 3:
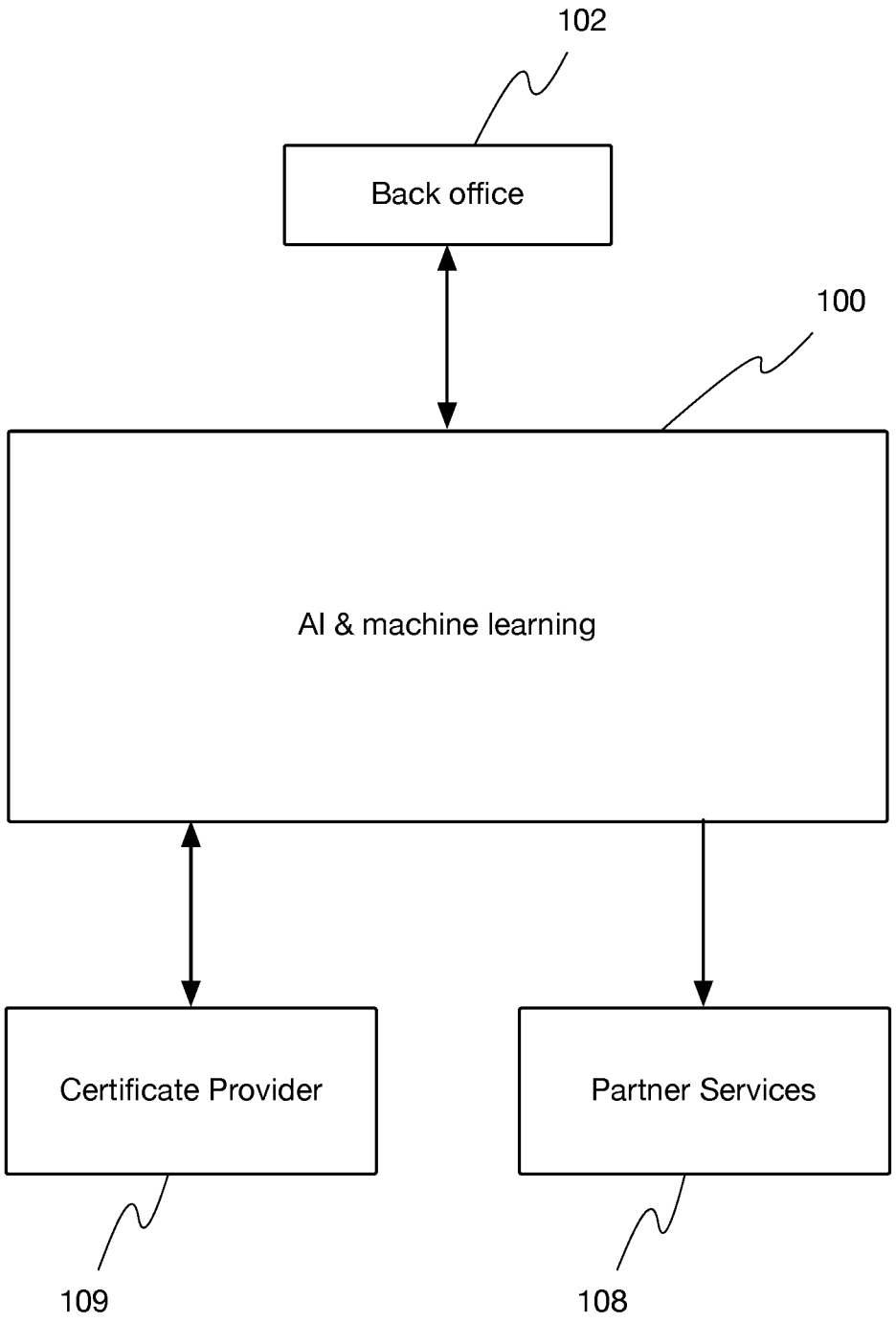
FIG. 3 illustrates a logical view of embodiments of the invention.

Referring to FIG. 1, embodiments include a server 100 for the high-speed ingestion of data from a number of sources. These include vehicle 104 105 component status from vehicles, data collected from local and regional sensors 106, information collected from emergency, environmental and other sources 102.

Data is collected at a server or which may take a number of forms including cloud services 101, centralized servers 100, and server farms. Data is analyzed using artificial intelligence (AI) and machine learning (ML) techniques to provide real time analysis, identify events, and provide Big Data analysis of trends and other information to allow for management decisions to be made by stakeholders. Alerts and notifications can be sent to drivers 107 and other stakeholders with a latency relevant to the timeliness of the information and the event.

Vehicle status includes any sensor output data available from vehicles. For example, odometer readings, dash board status (for example radio on/off, a/c status), door lock/unlock status, window opened, oil level, and status of brakes, tires, engine, HVAC, axles, anti-idling system, etc. are all part of vehicle status. Manufacturer or OEM specific data, such as identity, manufacturer, manufacture date, country of origin, and others may also be collected and associated with the sensor data as part of vehicle status.

Embodiments may also monitor current status of the driver. The gaze angle of the driver may be monitored along with their facial expressions as part of a driver profile. This may also include the driver's position and location of their hands during the operation which can be important aspects of the driver data. This can be matched with vehicle handling events such as harsh cornering, acceleration, or rolling stops.

The monitored data and its history allows to build high definition driver profile. Driver profile includes driver behaviour, driver attitude, driver awareness, driver motivation and driver skills. Driver profiles may be scored as to how they react to certain events. This may be an absolute score or may be a relative score when compared against other drivers in a fleet, company, city, region, or other category. Drivers may also be rated depending on driving conditions such as time or day, weather, rest time, or number of hours on the road.

A component of the driver profile is the driver's identity and embodiments may leverage a device, such as a cell phone, known to reside with the driver to aid in authenticating the driver. A cell phone may be used to accept a password, PIN, or to utilize biometric features to authenticate a driver. Biometric features include a fingerprint, or image of the driver's face. In some embodiments, the drive may be required to mount their cell phone where the cell phone camera is able to image the driver's face to record their status such as if they appear tired, sleepy, and the amount of time they are paying attention to the road. The functions of identifying a driver and capturing video of them may also be performed by hardware devices mounted in the vehicle.

Driver's and vehicles must also authentication with a central authority, of which there may be several. Examples would be a service provider, an employer, an insurance company, or a government agency. This may be done with a device such as a smart phone associated with an individual such as a driver or passenger. It may also be a device associated with the vehicle and may be a dongle installed in the vehicle, or a fob or portable device that is placed within or in proximity to the vehicle. Multiple devices such as a driver smart phone, passenger smart phone, and in vehicle hardware device may independently communicate with an authenticating authority, or the in-vehicle devices may form a network and authenticate one a single link to the authenticating authority.

Environmental conditions include weather, road condition and traffic. This environmental data is associated with vehicle status, driver profile, and other sensor data and provides context for the analysis and evaluation of the sensor data.

Vehicles may be outfitted with cameras and other light sensors to monitor and gather optical aspects of roads where the vehicle is travelling. This includes detecting road signs, number of lanes, obstacles, etc. Other information such as congestion, speed limit, type of road, obstacles and restrictions due to construction, accidents, or debris on the roadway may be gathered through external services. The data gathered are then analyzed in order to get higher accuracy. For example, speed limit from the external source may not be as accurate as detected speed signs from the vehicle.

Weather conditions are gathered for the current vehicle position. Wide area weather conditions may be obtained from weather reports for the area, the vehicle can measure factors such as temperature, humidity, wind speed and direction, and precipitation. This can be correlated with the driver's behaviour and data from vehicle components such as anti-lock braking, wheel slippage, etc. to produce an accurate model of the road conditions and environmental conditions in the immediate area.

Data from Smart City infrastructure, where a variety of data parameters are collected within an urban area and made available, bring additional values by allowing to collect information about transportation and infrastructure.

In embodiments of the invention vehicles are provisioned with one or more IoT modules that provide interfaces between the vehicle's on-board data busses, local wireless sensors, and external wireless networks. Vehicle IoT modules may be installed during vehicle manufacture, be installed by dealers before sale, or be after market devices. The modules allow the vehicles to connect to the server via the Internet and provide bi-directional data transfer.

Driver profile information may leverage the driver's cell phone using an installed application. The phone can connect to the vehicle using short range wireless protocols such as Bluetooth or directly to a server over the cellular or WiFi network.

Environmental information from the vehicle and driver behaviour is transmitted to the central server.

Embodiments of the invention capture, transmit, and receive large amounts of data from a large number of vehicles. At some times of day, such as during rush hour, the amount of data may peak, and the system must be able to handle these events.

Most embodiments will use cellular networks to transmit and receive information though in the case where other wireless communications infrastructure exists, such as urban WiFi, other protocols can be used together with or as an alternative to cellular networks. Cellular networking protocols such as cellular GSM, G3, G4, LTE will commonly be supported. Shorter range protocols such as WiFi (IEEE 802.11 family) protocols may also be supported.

Characteristics of cellular networks is that it is often bandwidth constrained so transmission protocols should have low overhead. Characteristics of the data to be communicated is that it is often small, so transmission protocols should allow for small packets to be sent. To meet these requirements, the network may support higher level protocols such as UDP (User Datagram Protocol) with security provided by DTLS (Datagram Transport Layer Security) protocols.

In some embodiments X.509 public key/private key authentication is used for encryption of data and communications.

Embodiments of the invention utilize AI and ML techniques to identify events and incidents that occur within or involving the vehicle, driver, or passengers. Training takes place at the server or similar centralized computing resource. Once an event is characterized a model is created to allow the identification of the event. The model may be customized for each individual vehicle and depends on a number of factors including the vehicle, year of manufacture, components, etc. The model is then used to allow for events to be identified either at the central processing resource or using onboard computers in a vehicle. Models may be incorporate other models. For example, a model for a vehicle as a whole may also include models for each major component in the vehicle. In the case of a tractor trailer vehicle, a compound model may include a model for the cab portion of the vehicle and another model for the trailer or for each trailer being towed.

In the case where event identification is performed centrally, sensor data is collected on the server. Training is performed to identify events that have occurred or are predicted to occur in the near future. The training is used to generate a model that is utilized on the server to identify events from data input. The events may then be transmitted to the vehicle and the driver or occupants informed.

In the case that event identification is done at a vehicular onboard computer, the onboard computer received sensor data from both the vehicle it is installed in as well as data from external sources. Using the AI/ML, model received from the central server, it processes the data to identify events that have happened, or to predict future events. Characterized events can be used to alert a driver or passenger and will also be transmitted to a central server to be used by other devices and nodes in the system.

Examples of events include any sudden acceleration or speed changes, harsh cornering, harsh stopping, sudden acceleration, and others. As well, sudden changes on component data can be detected and analyzed. For example, sudden tire pressure changes may indicate blown tire.

Embodiments of the invention must transmit and process large amounts of data and do so in a way that is fast enough to alert drivers and vehicles in time to react to potentially dangerous events. Data is received by a gateway and processed by a parser into a common format.

Figure 4:
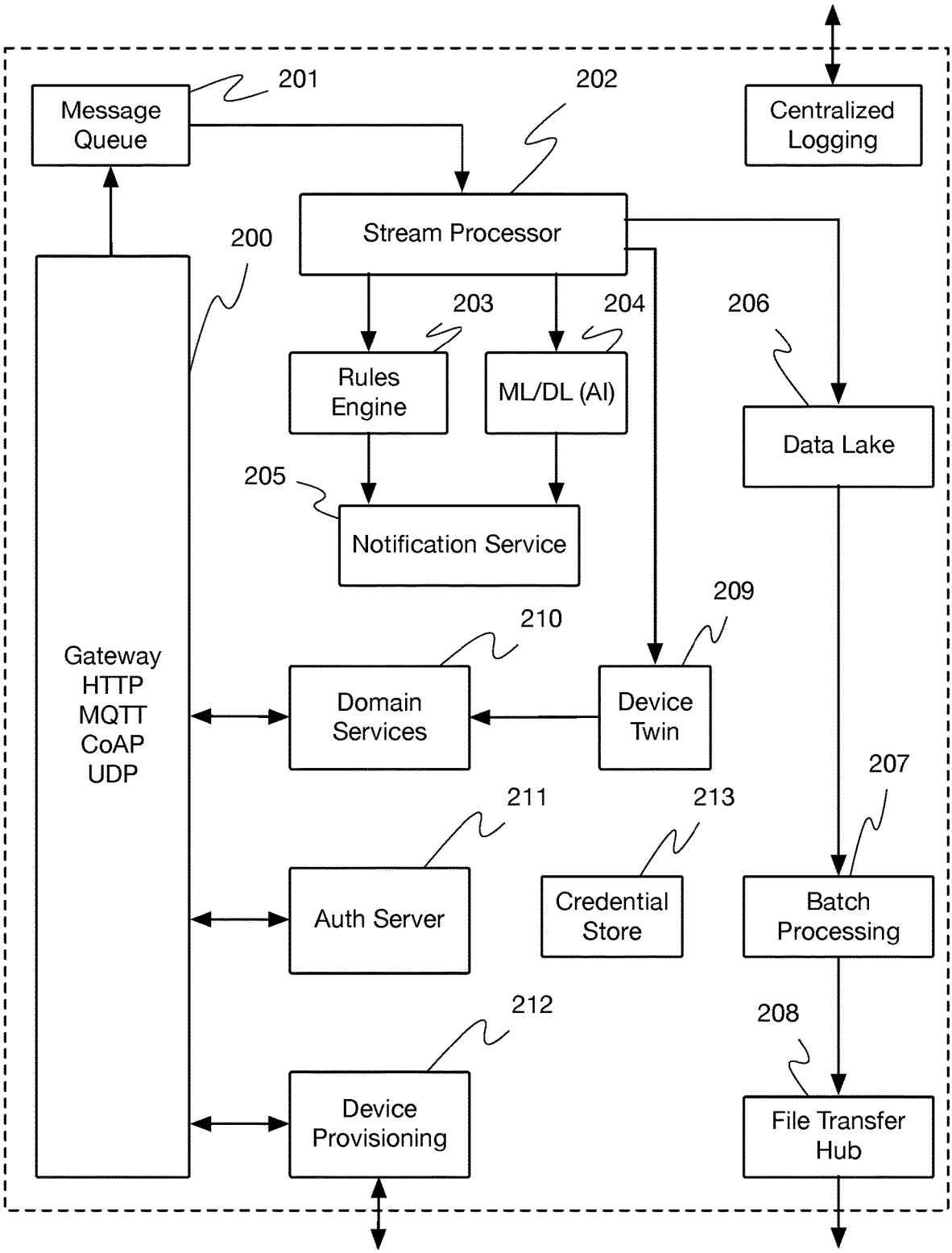
FIG. 4 illustrates a detailed view of the AI and machine learning component of embodiments of the invention.

Referring to FIG. 4, data received from vehicles, sensors, and other sources are received by a gateway 200 in a way designed to minimize latency and delay, while remaining secure. In some embodiments, CoAP (Constrained Application Protocol) over DTLS (Datagram Transport Layer Security) may be used by external data sources. CoAP provides a simpler protocol than HTTP yet can easily be translated to HTTP. CoAP is ideal for IoT devices and sensors that lack robust processing power. In these implementation, the CoAP request is translated to HTTP request. DTLS provides for secure transmission of datagrams to prevent forgery, tampering, or eavesdropping.

Several techniques may be used in order to minimize network latency and improve performance. In order to minimize the round-trip delay, early SSL (Secure Sockets Layer) termination may be used. Early SSL termination involves creating an SSL connection with a closer server in the case of communications with a distributed server architect such as a cloud computing server or a distributed CDN (Content Distribution Network.) The certificate identity verified during early SSL termination is passed to a translation process. The identity becomes a part of HTTP header.

Data from different sources arrives using different formats. In order to be processed by the system, data must be parsed, or converted into a common format or formats that may be used without further translation. This provides the system with the flexibility to extend and support multiple devices and protocols by writing new parser code to process the new data source. Each parser comprises a data schema of edge nodes (device, modules, or other data source) which is registered via a schema registration process. Each node can have different schema with different version numbers. Static information about the edge node is also stored during the registration process. This eliminates need for additional payload about edge module and allows reducing the size of request while preserving the flexibility required.

Received data is input to a message queue 201. The message queue acts as a reliable data buffer to avoid any data loss. The parsing process is performed by the stream processor 202 which receives data from the message queue 201. The stream processor comprises multiple streams to handle different types and sources of received data. A real time data stream, that cannot tolerate high latency in processing, requires that it be processed as soon as data comes in. Data associated with events that have less immediacy and data processing events may be processed by other streams in micro batches. The stream processor 202 can delegate data to multiple data processing services as well as intake processed data back in and delegate data to other data processing services.

Parsed data is prioritized by latency within which it must be processed as well as by the amount of time data must be collected over, a window, in order to obtain actionable results. A rules engine 203, together with the AI/machine learning algorithms 204 are used to process the latency sensitive data. The stateless rules may be based on a "fixed variables uses" rules engine in which the result of the rules engine triggers an event and this event can be fed back to the stream processor 202 for further processing. Some stateful sets of data can also be performed in set window sizes of data in the case of near real-time requirements. More elaborate event processing could be done after data gets rested on the data lake 206.

AI/machine learning algorithms 204 use online training that can be performed by this module. The confidence levels and accuracy between the online model and offline models are trained using data from the data lake 206 and compared to react to dramatic changes in the model from recent incidents. When a specific event was detected, the event is fed back to the stream processor 202 then either goes through further processing with other set of events or is rested on the data lake 206.

The results of this are used to provide a notification service 205 to the originating vehicle and other affected stakeholders. Any data from an external sensor, component, or source that is parsed into an internal format will be kept as a "device twin" 209, or internal format copy, for use by other components in the system without having to reparse the data.

Data that is not latency sensitive is stored in the data lake 206 for further processing. In some embodiments, all data, including latency sensitive data is sent to the data lake 206.

The data lake 206 is used to hold data that can tolerate a high latency response, or for data that must be collected over a window of time, batch data processing is separated from real-time data processing. Any processing that requires larger window of data falls into this category. The data in the data lake has not been fully processed and may not have a model associated with it. Any non-time critical analysis will be done using the batch processor 207.

Embodiments of the invention allow for the training of data and the building of a model. Once the data is processed it is preserved on a data store. Multiple analysis processes are then performed and produce a ML model or output analysis based on schedules.

An online-model method, whereas data is sequentially received it is used to update the model, may be used to decrease the time required to build or update a model. In this method, the weight of the online-model versus the training model is continually calculated during the training process.

Analysis include life span of parts/components, abnormally detection, maintenance scheduling, potential safety threat and so on. The created models are then pushed back to data processing layer for further improvement.

Data is further analyzed based on components' make, model and its history.

During the real time data processing phase, alert or notifications can be produced. Embodiments include a notification processor that can send notifications in a number of formats to stake holders including a vehicle driver, passenger, owner, fleet operator, etc. Examples of how a notification may be sent includes a mobile application, web portal, email, SMS, etc.

Trained model from AI/ML process can be pushed to the devices which were collecting data. This allows to offload work required on platform and allows for immediate feedback to the driver, operator, passenger, or other person in proximity to the vehicle.

Real-time data stream for monitoring and third-party consumption

Embodiments include a portal to view and monitor real-time data is provided. Data may be exposed via APIs to all for the exporting of filtered anonymous data set to external system. Examples of access methods include WebHook and REST endpoints.

Anonymized historical data based on categories (e.g. parts, manufacturer, etc.) can be queried by external partners.

A variety of applications are enabled through embodiments of the invention.

In many situations a road may have a blind corner or crest where a driver and vehicle sensors do not have a line of sight to an obstacle or hazardous road condition. Examples would be a large pothole, animal on the road, stopped vehicle, or icy or flooded roadway. Conventional means of viewing or sensing the road may not detect these hazards until it is too late to avoid an accident. However, using embodiment of the invention, information from another vehicle that precedes a vehicle may be used to provide an active or passive warning to the driver of a vehicle. A previous vehicle may have applied the brakes quickly, swerved to avoid an obstacle, or lost traction on ice. Sensors in the previous vehicle may detect this and transmit data for processing. The AI/ML algorithms will detect the event that has occurred and send an alert to the driver of other vehicles to allow them time to reduce speed or stop. In some cases, the driver will be alerted using audio, visual, or audio-visual alerts. In other cases, a vehicle may also automatically apply brakes or engage other safety measures. On a busy road, the more vehicles traversing the road in the area of the hazard, the better the characterization of the hazard and the more accurate the AI/ML model will be. In some cases, on detection of a hazard, road maintenance authorities will also be informed so that they may dispatch vehicles and crew to clear the hazard.

The large amount of data collected allows for scores to be calculated for drivers, vehicles, vehicle components, and other components. The effect of weather may be quantified. The performance, effectiveness, and longevity of vehicles and components may be evaluated. Preventative maintenance may be done based on actual component profiles, considering the vehicles they are installed in, the driver's performance, the weather, and other factors.

Obstacles and degradation of road surfaces may be detected using embodiments of the system. Obstacles may be detected using data from brakes, steering and accelerometers in vehicles to detect bumps. The severity and ease of avoidance of obstacles may also be evaluated by determining the number of vehicles that avoid the obstacle out of the total number of vehicles using the same road. Obstacle data may be automatically sent to road repair crews to address the problem in a timely manner.

The ensuing description provides representative embodiment(s) only, and is not intended to limit the scope, applicability or configuration of the disclosure. Rather, the ensuing description of the embodiment(s) will provide those skilled in the art with an enabling description for implementing an embodiment or embodiments of the invention. It being understood that various changes can be made in the function and arrangement of elements without departing from the spirit and scope as set forth in the appended claims. Accordingly, an embodiment is an example or implementation of the inventions and not the sole implementation. Various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention can also be implemented in a single embodiment or any combination of embodiments.

Reference in the specification to "one embodiment", "an embodiment", "some embodiments" or "other embodiments" means that a particular feature, structure, or characteristic described in connection with the embodiments is included in at least one embodiment, but not necessarily all embodiments, of the inventions. The phraseology and terminology employed herein is not to be construed as limiting but is for descriptive purpose only. It is to be understood that where the claims or specification refer to "a" or "an" element, such reference is not to be construed as there being only one of that element. It is to be understood that where the specification states that a component feature, structure, or characteristic "may", "might", "can" or "could" be included, that particular component, feature, structure, or characteristic is not required to be included.

Reference to terms such as "left", "right", "top", "bottom", "front" and "back" are intended for use in respect to the orientation of the particular feature, structure, or element within the figures depicting embodiments of the invention. It would be evident that such directional terminology with respect to the actual use of a device has no specific meaning as the device can be employed in a multiplicity of orientations by the user or users.

Reference to terms "including", "comprising", "consisting" and grammatical variants thereof do not preclude the addition of one or more components, features, steps, integers or groups thereof and that the terms are not to be construed as specifying components, features, steps or integers. Likewise, the phrase "consisting essentially of", and grammatical variants thereof, when used herein is not to be construed as excluding additional components, steps, features integers or groups thereof but rather that the additional features, integers, steps, components or groups thereof do not materially alter the basic and novel characteristics of the claimed composition, device or method. If the specification or claims refer to "an additional" element, that does not preclude there being more than one of the additional element.

What is claimed is:

1. A method of operating an incident avoidance system for use in a vehicle, the method comprising:

receiving, by a gateway, a plurality of vehicular data samples from a plurality of data sources in a vicinity of a target vehicle;

categorizing, by a stream processor coupled to the gateway, a plurality of low latency data samples from the plurality of vehicular data samples based on an allowable latency of each of the plurality of vehicular data samples;

receiving, by a rules engine coupled to the stream processor, the plurality of low latency data samples, the rules engine deriving a predictive model based on the plurality of low latency data samples;

accessing, by a notification service, the predictive model and situational data of the target vehicle to predict an incident;

transmitting, by the notification service, a notification of the incident to the target vehicle and:

categorizing, by the stream processor, a plurality of high latency data samples from the plurality of vehicular data samples based on a predefined latency of each of the plurality of vehicular data samples;

storing, by the stream processor, the plurality of high latency data samples in a data lake; and processing, by a batch processor, the plurality of high latency data samples.

2. The method of claim 1 further comprising:

converting, by the gateway, each of the plurality of vehicular data samples into a common internal format.

3. The method of claim 2 further comprising storing a copy of each of the plurality of vehicular data samples in the common internal format.

4. The method of claim 1 wherein a subsequent low latency data sample received by the rules engine is used to update the predictive model.

5. The method of claim 1, wherein the predictive model is also derived based on the plurality of high latency data samples.

6. The method of claim 5, wherein the predictive model is a machine learning model trained in part, on the plurality of high-latency data samples stored in the data lake.

7. The method of claim 1 wherein the predictive model comprises an offline model and an online model.

8. An incident avoidance system comprising:

a gateway coupled to a plurality of data sources in a vicinity of a target vehicle over a network, the gateway configured to receive a plurality of vehicular data samples from the plurality of data sources;

a stream processor coupled to the gateway, the stream processor categorizing a plurality of low latency data samples from the plurality of vehicular data samples based on an allowable latency of each of the plurality of vehicular data samples;

a rules engine coupled to the stream processor, the rules engine receiving the plurality of low latency data samples, the rules engine deriving a predictive model based on the plurality of low latency data samples; and a notification service coupled to the rules engine, the notification service accessing the predictive model and situational data of the target vehicle to predict an incident, the notification service configured to transmit a notification of the incident to the target vehicle; and the stream processor further categorizes a plurality of high latency data samples from the plurality of vehicular data samples based on a predefined latency of each of the plurality of vehicular data samples, the system further comprising a data lake and a batch processor, the stream processor storing the plurality of high latency data samples in the data lake, the batch processor processing the plurality of high latency data samples.

9. The system of claim 8 further wherein the gateway converts each of the plurality of vehicular data samples into a common internal format.

10. The system of claim 9 wherein a copy of each of the plurality of vehicular data samples is stored in the common internal format.

11. The system of claim 8 wherein a subsequent low latency data sample received by the rules engine is used to update the predictive model.

12. The system of claim 8, wherein the predictive model is also derived based on the plurality of high latency data samples.

13. The system of claim 12, wherein the predictive model is a machine learning model trained in part, on the plurality of high-latency data samples stored in the data lake.

14. The system of claim 8 wherein the predictive model comprises an offline model and an online model.

* * * * *